US006880292B2

(12) United States Patent
Okahara

(10) Patent No.: US 6,880,292 B2
(45) Date of Patent: Apr. 19, 2005

(54) GLASS GUIDE CONSTRUCTION FOR VEHICULAR DOORS HAVING A BENT GUIDE PORTION

(75) Inventor: Gentaro Okahara, Shizuoka (JP)

(73) Assignee: Suzuki Motor Corporation, Shizouka-Ken (JP)

( * ) Notice: Subject to any disclaimer, the term of this patent is extended or adjusted under 35 U.S.C. 154(b) by 42 days.

(21) Appl. No.: 10/284,154

(22) Filed: Oct. 31, 2002

(65) Prior Publication Data

US 2003/0089044 A1 May 15, 2003

(30) Foreign Application Priority Data

Nov. 15, 2001 (JP) ..... 2001-350010
Mar. 26, 2002 (JP) ..... 2002-084837

(51) Int. Cl.[7] ..... E06B 7/16
(52) U.S. Cl. ..... 49/414; 49/428
(58) Field of Search ..... 49/428, 415, 416, 49/374, 376, 372, 502, 348, 349, 414

(56) References Cited

U.S. PATENT DOCUMENTS 2,449,210 A * 9/1948 Faust ..... 49/452
2,907,564 A * 10/1959 Wise ..... 49/227
2,922,639 A * 1/1960 Martens ..... 49/227
2,947,569 A * 8/1960 McDougall ..... 49/227
3,466,802 A * 9/1969 Doveinis et al. ..... 49/428
4,653,230 A * 3/1987 Seo et al. ..... 49/502
6,430,878 B1 * 8/2002 Terasawa et al. ..... 49/416

FOREIGN PATENT DOCUMENTS

JP 6-297955 10/1994
JP 11011151 1/1999

OTHER PUBLICATIONS

English Language Abstract for JP Appln. No. 06–297955.

English Language Abstract of JP Appln. No. 11–011151.

* cited by examiner

*Primary Examiner*—Gregory J. Strimbu
(74) *Attorney, Agent, or Firm*—Greenblum & Bernstein, P.L.C.

(57) ABSTRACT

A guide assembly guides a glass pane into a panel body of a vehicular door. The door includes an upper door guide and a lower door guide provided in a vertically spaced relation to the upper door guide. A guide portion extending outward from the lower door guide is provided at an upper end of the lower the guide assembly.

9 Claims, 7 Drawing Sheets

GLASS GUIDE CONSTRUCTION FOR VEHICULAR DOORS HAVING A BENT GUIDE PORTION

BACKGROUND OF THE INVENTION

1. Field of the Invention

The present invention relates to a glass guide construction for a door provided in a vehicle such as an automobile, and more particularly to a door sash construction provided in a door panel and supporting a window glass pane.

2. Description of the Related Art

One example of an automobile door panel includes a door panel body formed by connecting an outer door panel and an inner door panel, an upper door sash mounted to an upper portion of the door panel body, and a lower door sash provided under a front lower portion of the upper door sash for guiding vertical movement of a window glass pane. Depending on the door panel structure, however, the glass pane cannot be mounted in place because of the presence of the lower door sash that has been mounted beforehand. In such a case, the glass pane is assembled beforehand, and the lower door sash is then assembled in a condition where the glass pane is held in an elevated position.

More specifically, as shown in FIG. 9, when assembling a window glass pane 103 in a door panel 101, the glass pane 103 is first supported in an oblique position (P1) above the door panel 101 before mounting the lower door sash. The glass pane 103 is translationally moved downward (P2) while holding such an oblique position. After rotating the glass pane 103 from the position P2 to P4 through P3 successively, the glass pane 103 is translationally moved upward (P5) while holding a horizontal position. Then, the lower door sash (not shown) is mounted to the door panel 101 by bolts while holding the glass pane 103 in that elevated position.

Thus, a worker has to mount the lower door sash to the door panel 101 while holding the glass pane 103 in the elevated position. Accordingly, a larger number of assembly steps have been required to assemble the glass pane 103, and hence a longer time has been required to mount the glass pane 103 in place. Also, when assembling the glass pane 103, there has been a risk that the glass pane 103 may be caught by a corner of the door panel 101 and damaged.

SUMMARY OF THE INVENTION

With the view of overcoming the problems mentioned above, it is an object of the present invention to provide a glass guide construction for a vehicular door, which can reduce the number of steps required for assembling a glass pane, and minimize the risk that the glass pane may be damaged during assembly.

To achieve the above object, according to one aspect of the present invention, there is provided a glass guide construction for a vehicular door in which an upper door sash that guides a door panel is provided in a window opening formed in a door panel body of the vehicular door, and a lower door sash for guiding the glass pane into the door panel body is provided in the door panel body at a position under the upper door sash, wherein a front lower door sash is provided under a front lower portion of the upper door sash vertically spaced from a lower end of the front lower portion, and a guide portion bent and extending obliquely forwardly is provided at an upper end of the front lower door sash.

According to another aspect of the present invention, there is provided a glass guide construction for a vehicular door in which an upper door sash that guides a glass pane is provided in a window opening formed in a door panel body of the vehicular door, and a lower door sash that guides the glass pane into the door panel body is provided in the door panel body at a position under the upper door sash, wherein the glass pane is formed such that an outer peripheral shape is defined by lines connecting at least four front lower, rear lower, front upper and rear upper corners of the glass pane, and that, of diagonal lines connecting the corners, one diagonal line passing through the front lower corner is longer than the other diagonal line; and wherein a front lower door sash is provided under a front lower portion of the upper door sash vertically spaced from a lower end of the front lower portion, and a guide portion bent and extending obliquely forwardly is provided at an upper end of the front lower door sash.

According to still another aspect of the present invention, there is provided a glass guide structure for a vehicular door in which an upper door sash that guides a glass pane is provided in a window opening formed in a door panel body of the vehicular door, and a lower door sash that guides the glass pane into the door panel body is provided in the door panel body at a position under the upper door sash, wherein the glass pane is formed such that an outer peripheral shape is defined by lines connecting at least four front lower, rear lower, front upper and rear upper corners of the door glass, and that, of diagonal lines connecting the corners, one diagonal line passing through the rear lower corner is longer than the other diagonal line; and wherein a rear lower door sash is provided under a rear lower portion of the upper door sash vertically spaced from a lower end of the rear lower portion, and a guide portion bent and extending obliquely rearwardly is provided at an upper end of the rear lower door sash.

According to still another aspect of the present invention, there is provided a glass guide construction for a vehicular door in which an upper door sash that guides a glass pane is provided in a window opening formed in a door panel body of the vehicular door, and a lower door sash that guides the glass pane into the door panel body is provided in the door panel body at a position under the upper door sash, wherein a front lower door sash is provided under a front lower portion of the upper door sash vertically spaced from a lower end of the front lower portion, and a guide portion bent and extending obliquely forwardly is provided at an upper end of the front lower door sash; and wherein a rear lower door sash is provided under a rear lower portion of the upper door sash vertically spaced from a lower end of the rear lower portion, and a guide portion bent and extending obliquely rearwardly is provided at an upper end of the rear lower door sash.

Additionally, according to still another aspect, the present invention may be modified to provide a glass guide construction for a vehicular door in which an upper door sash that guides a glass pane is provided in a window opening formed in a door panel body of the vehicular door, and a lower door sash that guides the door glass into the door panel body is provided in the door panel body at a position under the upper door sash, wherein a rear lower door sash is provided under a rear lower portion of the upper door sash vertically spaced from a lower end of the rear lower portion, and a guide portion bent and extending obliquely rearwardly is provided at an upper end of the rear lower door sash.

A further aspect of the present invention provides a glass guide construction for a vehicular door, wherein the guide portion is bent at a base end and extends linearly to an upper end. The linearly extending upper end of the guide portion may form an acute angle with a line between the lower end of the front lower portion of the upper door sash and the base end of the guide portion. Further, the base end of the guide portion may be formed unitarily and in one piece with the front lower door sash; or the base end of the guide portion may be fastened to the front lower door sash. The guide portion may be configured such that the width of the guide portion in a direction substantially transverse to a longitudinal direction from the base end toward the upper end gradually increases from the base end toward the upper end; and the width of the guide portion at the base end and the width of the guide portion at the upper end may each be greater than the width of the lower end of the front lower portion of the upper door sash.

In a further aspect of the present invention, the guide portion may be configured such that a cross-section thereof, taken in a direction substantially transverse to a longitudinal direction from the base end toward the upper end, may have a trapezoidal shape defined by opposite side portions that are inclined to each other so as to provide a gradually increasing opening width therebetween.

A further aspect of the present invention may provide an upper door sash that guides a glass pane in a window opening formed in a door panel body of the vehicular door, and a lower door sash that guides the glass pane into the door panel body in the door panel body at a position under the upper door sash, wherein a rear lower door sash may be provided under a rear lower portion of the upper door sash vertically spaced from a lower end of the rear lower portion, and a guide portion bent and extending obliquely rearwardly may be provided at an upper end of the rear lower door sash.

BRIEF DESCRIPTION OF THE DRAWINGS

The above, and other objects, features, and advantages of the present invention will be made apparent from the following description of the preferred embodiments, given as nonlimiting examples, with reference to the accompanying drawings in which.

DETAILED DESCRIPTION OF THE PREFERRED EMBODIMENTS

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description is taken with the drawings making apparent to those skilled in the art how the forms of the present invention may be embodied in practice.

A glass guide construction for a vehicular door according to an embodiment of the present invention will be described below in detail with reference to the drawings. While a lower door sash may include either one or both of a front lower door sash provided under a front lower portion of an upper door sash and a rear lower door sash provided under a rear lower portion of the upper door sash, the following description is made of an embodiment in which the front lower door sash and the rear lower door sash are both provided.

Figure 1:
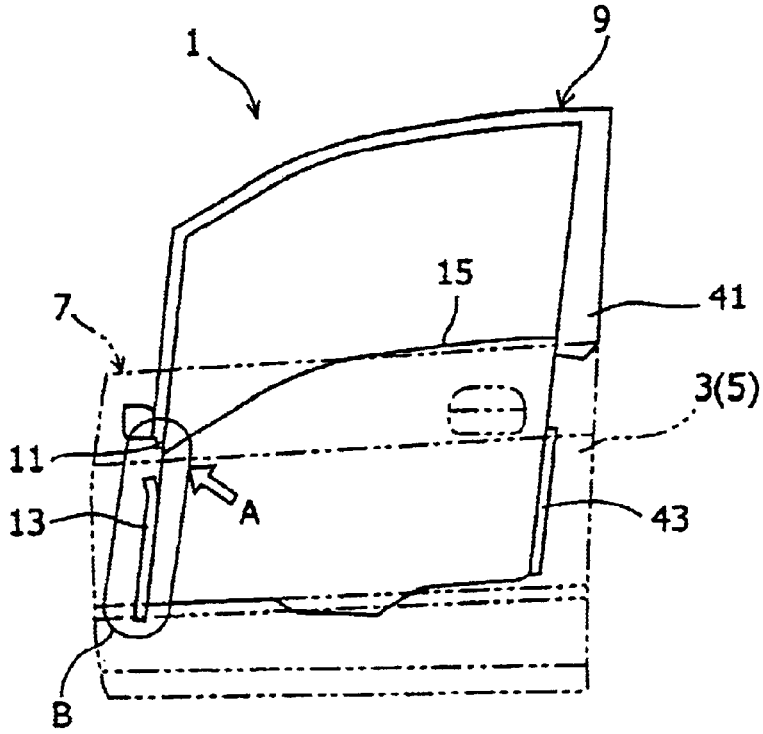
FIG. 1 is a front view showing a door panel according to the present invention.

FIG. 1 is a front view showing a door panel 1 according to the present invention. The door panel 1 includes a door panel body 7 which includes an outer door panel 3 and an inner door panel 5, a gate-shaped upper door sash 9 positioned to project above the door panel body 7, a front lower door sash 13 provided under a front lower portion 11 of the upper door sash 9, a rear lower door sash 43 provided under a rear lower portion 41 of the upper door sash 9, and a glass pane 15 engaging the upper door sash 9 in such a manner to slide vertically.

Figure 2:
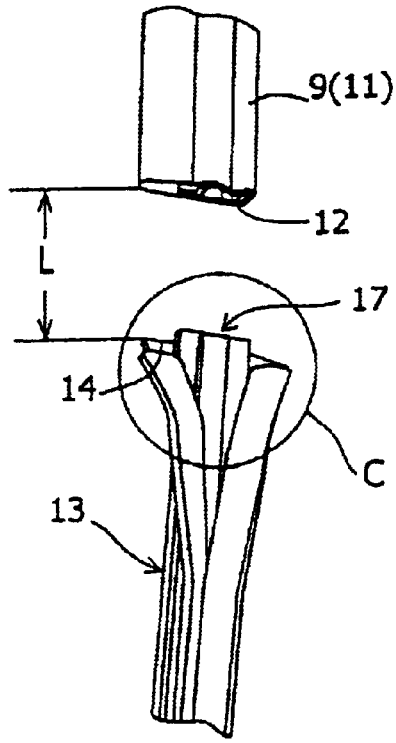
FIG. 2 is a perspective view showing a portion around an upper end of the front lower door sash in FIG. 1, looking from a direction A indicated in FIG. 1.
Figure 3:
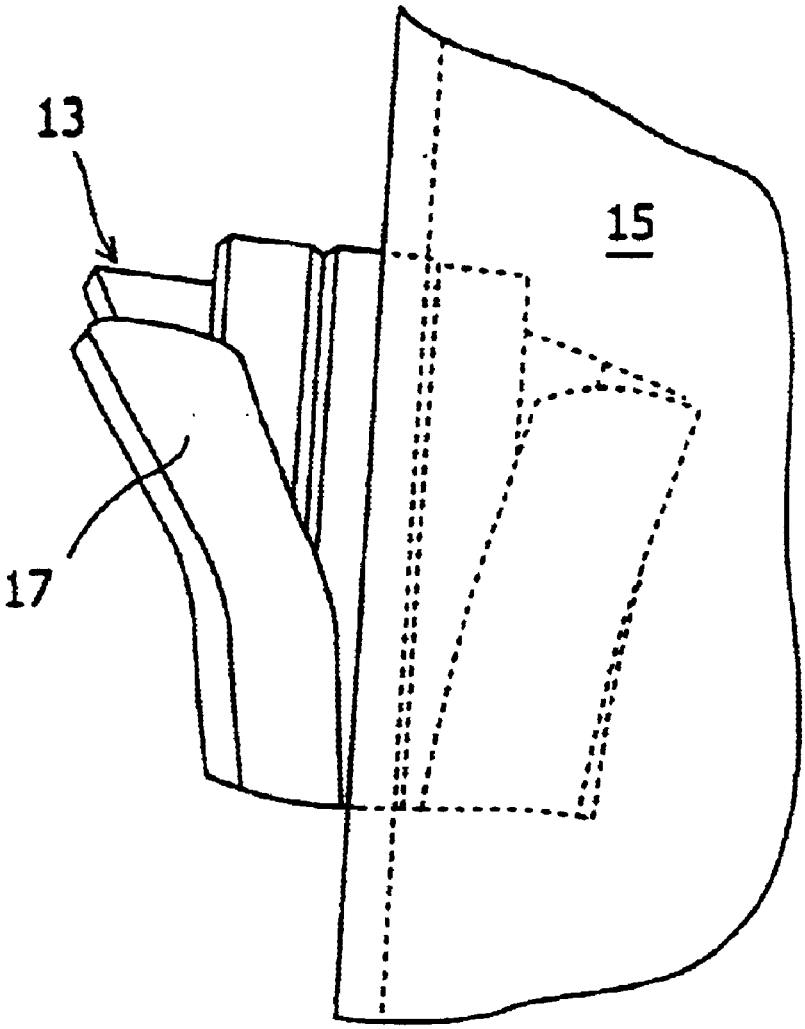
FIG. 3 is an enlarged perspective view showing a portion C indicated in FIG. 2.

FIG. 2 is a perspective view showing a portion around an upper end of the front lower door sash 13 in FIG. 1, looking from the side obliquely behind the upper end (direction A indicated in FIG. 1). As shown in FIG. 2, the front lower door sash 13 is provided with a glass run 17 on the rear (back) side thereof, and a front lower end 12 of the upper door sash 9 is vertically spaced a distance L from an upper end 14 of the front lower door sash 13. As described later in connection with FIG. 8, the distance L is preferably set to such a proper value that sufficient work space for assembling the glass pane 15 can be ensured. Further, as shown in FIG. 3, the glass pane 15 is provided to be able to vertically move along a rear (back) surface of the glass run 17.

Figure 4:
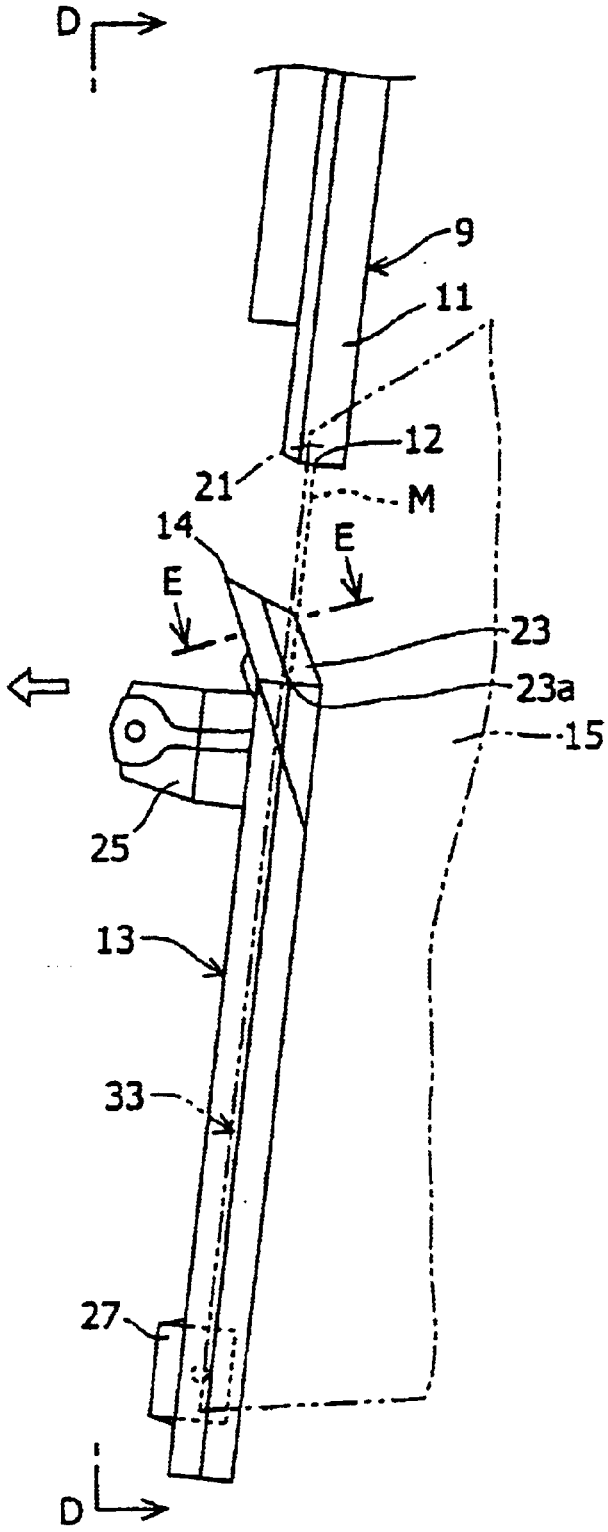
FIG. 4 is an enlarged front view showing a portion B indicated in FIG. 1.

Further, as shown in FIG. 4, the front lower portion 11 of the upper door sash 9 is slightly inclined forward, and a front upper corner 21 of the glass pane 15 positioned at an upper end of a front side edge 33 thereof is engaged with the front lower portion 11 of the upper door sash 9. A forwardly inclined guide portion 23 is provided at the top of the front lower door sash 13. The guide portion 23 is bent at its base end 23*a* and then extends obliquely forwardly in a line to its upper end 14. The upper end 14 of the guide portion 23 is positioned on the front side of a straight line M (see a broken line in FIGS. 4 and 8) connecting the front lower end 12 of the front lower portion 11 of the upper door sash 9 and the base end 23*a* of the guide portion 23. An inclination angle formed by the guide portion 23 and the straight line M forms an acute angle. The guide portion 23 can be formed unitarily and in one piece with the front lower door sash 13. Alternatively, the guide portion 23 may be attached to the front lower door sash 13 by any suitable fastening members (not shown), such as for example, screws, clips or rivets.

Figure 5:
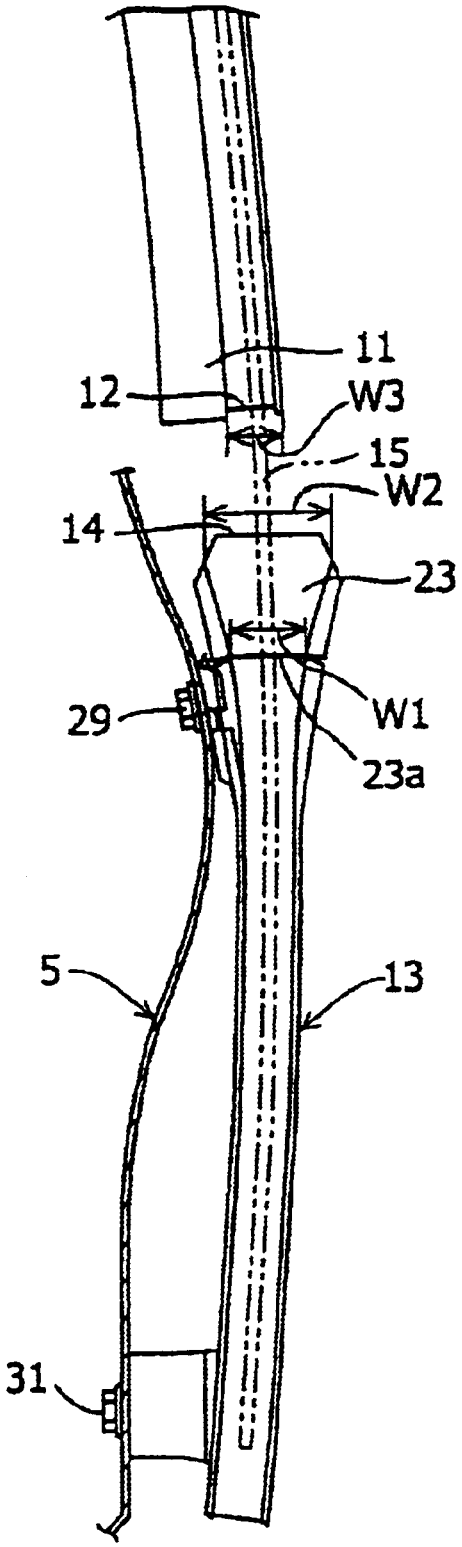
FIG. 5 is a sectional view taken along the line D—D in FIG. 4.

Also, as shown in FIG. 5, the guide portion 23 is formed so as to gradually spread upward from the base end 23*a* toward the upper end 14. More specifically, the guide portion 23 is formed such that the width thereof gradually increases from the base end 23*a* (width W1) toward the upper end 14

(width W2). The width W1 of the base end 23*a* and the width W2 of the upper end 14 are both selected to be greater than a width W3 of the front lower end 12 of the front lower portion 11 of the upper door sash 9.

Furthermore, brackets 25, 27 bent to extend forward are provided on upper and lower lateral surfaces of the front lower door sash 13. The brackets 25, 27 are attached to the inner door panel 5 by bolts 29, 31, respectively.

Figure 6:
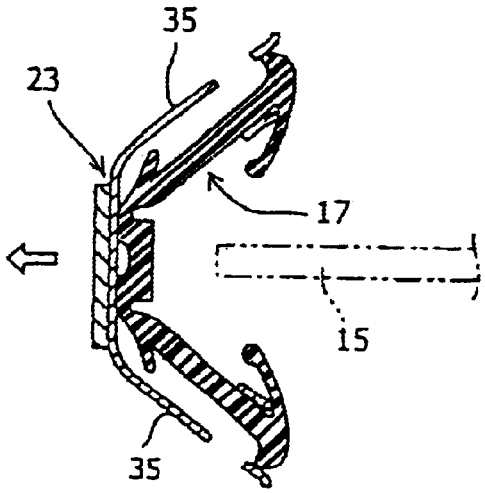
FIG. 6 is a sectional view taken along the line E—E in FIG. 4.

Moreover, as shown in FIG. 6, the guide portion 23 of the front lower door sash 13 has a cross-section substantially in the trapezoidal form defined by opposite side areas 35, 35 which are inclined so as to provide an opening gradually increasing rearward. Also, the glass run 17 is attached to the rear side of the guide portion 23 such that the glass run 17 also opens rearwardly substantially in the trapezoidal form in conformity with the section of the front lower door sash 13. In addition, the glass pane 15 capable of moving vertically is provided on the rear side of the glass run 17.

With the door panel 1 thus constructed, since the guide portion 23 is provided at the top of the front lower door sash 13, assembly efficiency of the glass pane 15 can be improved. Also, because of the guide portion 23 being formed so as to gradually spread upward, when rainwater or other water enters the inside of the door, the guide portion 23 is able to efficiently receive the water. Therefore, rainwater or other water can be prevented from leaking into the vehicle compartment and can be surely discharged out of the vehicle. Further, the glass pane 15 can be assembled after mounting the lower door sashes 13, 43 in place.

Steps of assembling the glass pane 15 into the vehicular door panel 1 having the construction set forth above will be described below.

Figure 7:
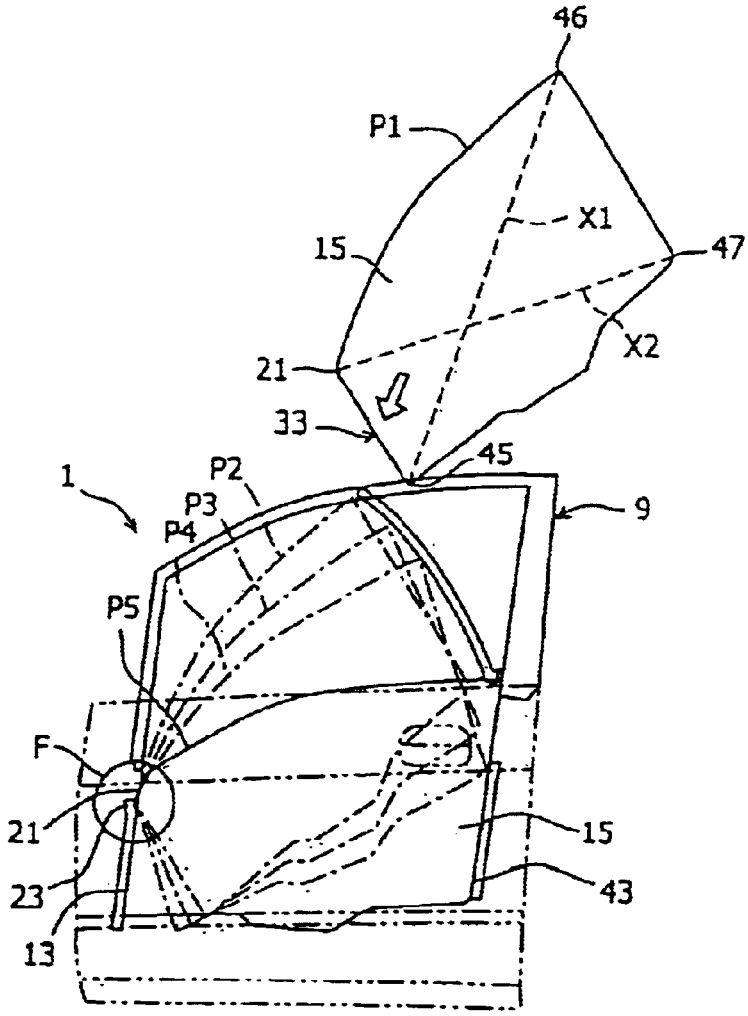
FIG. 7 is a schematic view showing steps of assembling a glass pane and the door panel according to the present invention of FIG. 1.

As shown in FIG. 7, assuming that a diagonal line connecting a front lower corner 45 and a rear upper corner 46 of the glass pane 15 is denoted by X1 and a diagonal line connecting the front upper corner 21 and a rear lower corner 47 of the glass pane 15 is denoted by X2, the glass pane 15 is formed such that the diagonal line X1 is longer than the diagonal line X2.

Figure 8:
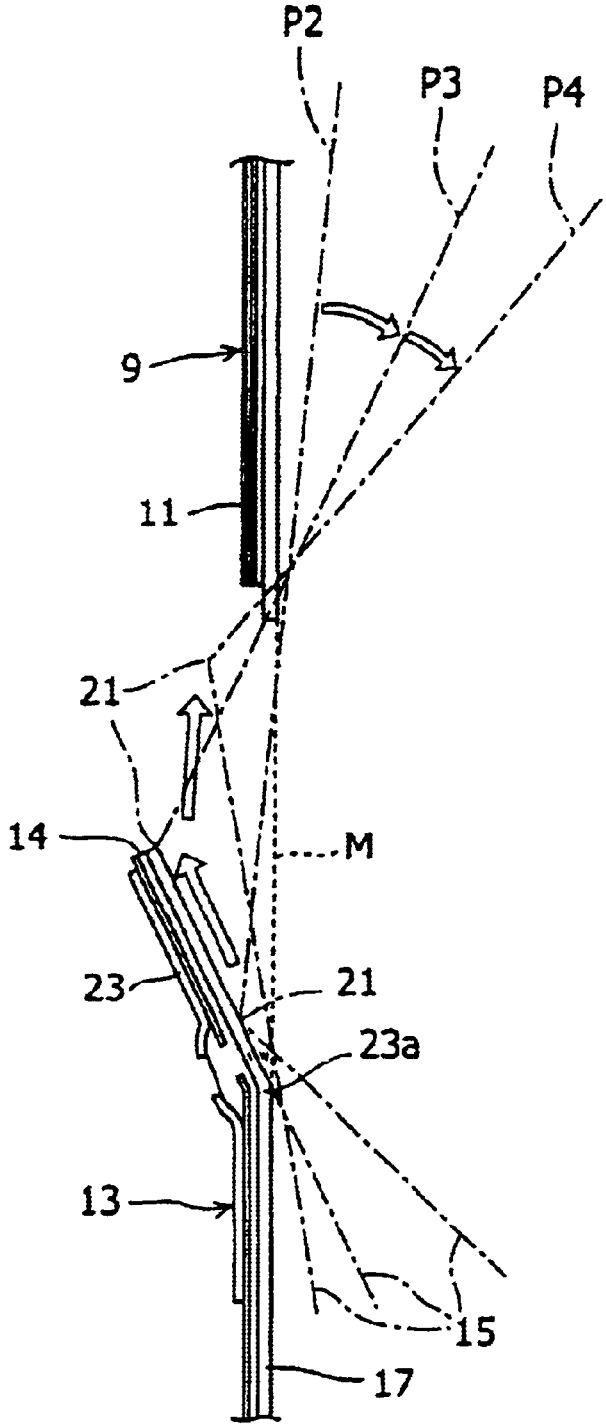
FIG. 8 is an enlarged front view showing a portion F indicated in FIG. 7.
Figure 9:
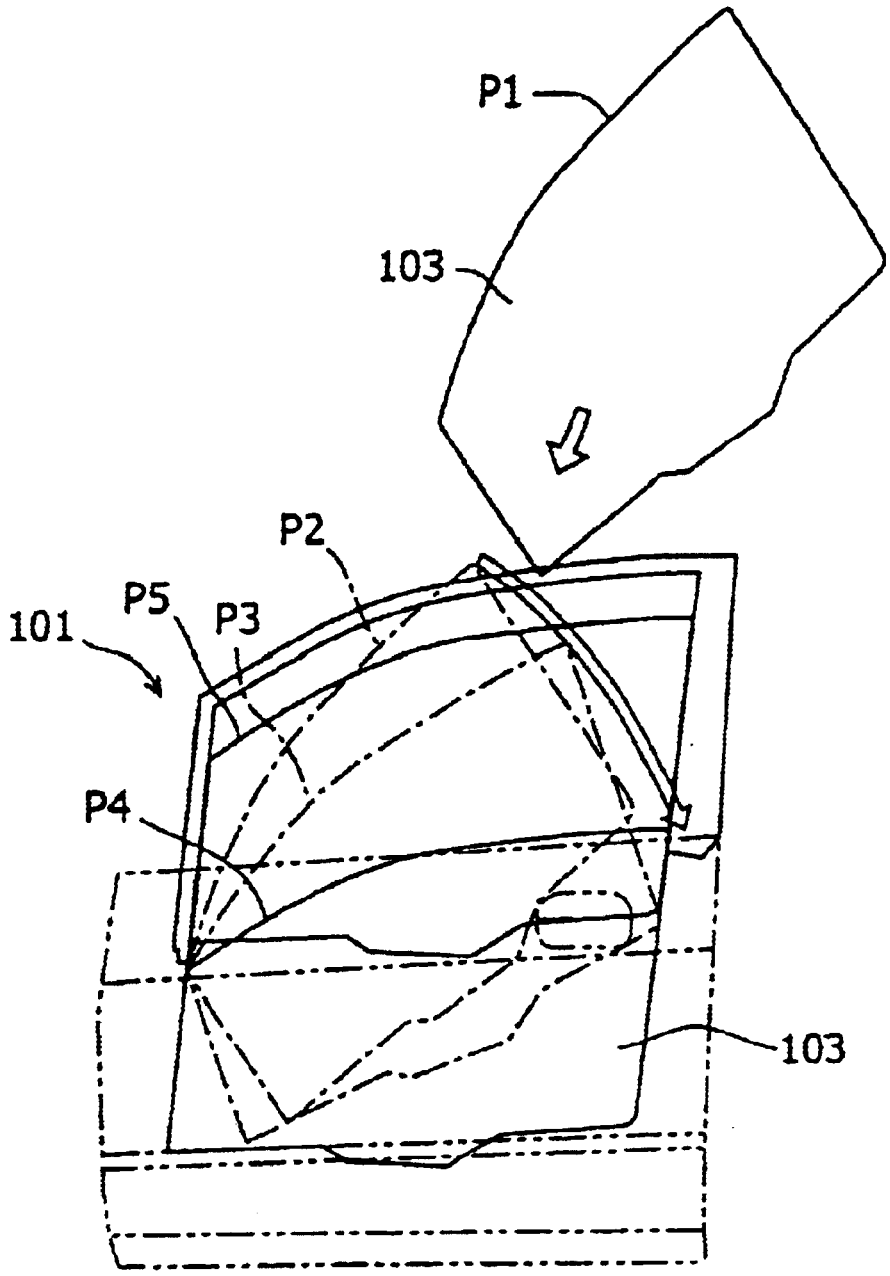
FIG. 9 PRIOR ART
FIG. 9 is a schematic view showing steps of assembling a glass pane and a conventional door panel.

First, the upper door sash 9 and the lower door sashes 13, 43 are mounted in place prior to mounting of the glass pane 15. Then, the glass pane 15 is supported (as indicated by P1) above the door panel 1 while holding the front lower corner 45 of the glass pane 15 to be positioned below the rear lower corner 47 thereof such that the glass pane 15 is inclined with its front side at a lower level than its rear side. Thereafter, the glass pane 15 is translationally moved downward (P2) so as to reach the lower portion of the door panel 1 while holding such an oblique position. At this time, as shown in FIG. 8, the front upper corner 21 of the glass pane 15 abuts and is supported by the glass run 17 attached to the guide portion 23. Then, the glass pane 15 is rotated clockwise (P3 and P4) by lowering the rear side of the glass pane 15 while the front upper corner 21 of the glass pane 15 is forced to slide over the glass run 17. Finally, as shown in FIG. 7, the glass pane 15 is placed at a position where almost the overall length of the front side edge 33 thereof abuts the front lower door sash 13. The assembly of the glass pane 15 is thereby completed.

It is to be noted that the present invention is not limited to the above-described embodiment, but can be changed and modified in various ways based on the technical concept of the present invention.

For example, the lower door sashes 13, 43 can also be provided on any type of door panel for various types of vehicles other than automobiles.

While the guide portion 23 is provided on the front lower door sash 13 in the embodiment described above, it may be provided on the rear lower door sash 43. More specifically, when mounting a glass pane in which the diagonal line X2 is longer than the diagonal line X1, the glass pane is supported while holding the front lower corner 45 and the rear lower corner 47 of the glass pane, both of which are located on the longer diagonal line X2, such that the rear lower corner 47 is positioned below the front lower corner 45, i.e., that the glass pane 15 is inclined with its front side held at a lower level than its rear side. In that case, the rear lower door sash 43 is provided under the rear lower portion 41 of the upper door sash 9 in a vertically spaced relation to a lower end of the rear lower portion 41, and a guide portion bent to obliquely extend rearward is provided at an upper end of the rear lower door sash 43.

According to one aspect, as described above, the present invention resides in a glass guide structure for a vehicular door in which an upper door sash for guiding a glass pane is provided in a window opening formed in a door panel body of the vehicular door, and a lower door sash for guiding the glass pane into the door panel body is provided in the door panel body at a position under the upper door sash, wherein a front lower door sash is disposed under a front lower portion of the upper door sash in a vertically spaced relation to a lower end of the front lower portion, and a guide portion bent to extend obliquely forwardly is provided at an upper end of the front lower door sash. Therefore, the spacing between the lower end of the front lower portion of the upper door sash and the upper end of the front lower door sash can be utilized as a work space for assembling the glass pane. All of the door sashes can be mounted prior to assembling of the glass pane, and the number of assembly steps can be reduced in comparison with conventional procedures of mounting a lower door sash after assembling a glass pane. Further, since the glass pane is assembled in a condition where the front lower door sash has been mounted beforehand, it is possible to avoid a change in assembly arrangement for mounting the front lower door sash, and to reduce a space occupied by equipment necessary for the assembly. There is no risk that the glass pane may be damaged, because the glass pane is assembled after mounting all of the door sashes. Moreover, since the glass pane can be assembled in place by rotating it while keeping a front upper corner of the glass pane in abutment with the guide portion, even a worker who is not skilled in the assembly of the glass pane can easily perform the assembly, and the number of steps can be reduced. In addition, since the guide portion is able to receive rainwater or other water having entered the door panel, the water can be prevented from leaking into the vehicle compartment and can be surely discharged out of the vehicle.

According to another aspect, the present invention resides in a glass guide structure for a vehicular door in which an upper door sash for guiding a glass pane is provided in a window opening formed in a door panel body of the vehicular door, and a lower door sash for guiding the glass pane into the door panel body is provided in the door panel body at a position under the upper door sash, wherein the glass pane is formed such that an outer peripheral shape is defined by lines connecting at least four front lower, rear lower, front upper and rear upper corners of the glass pane, and that, of diagonal lines connecting the corners, one diagonal line passing the front lower corner is longer than the other; and wherein a front lower door sash is disposed under a front lower portion of the upper door sash in a vertically spaced relation to a lower end of the front lower portion, and a guide portion bent to extend obliquely forwardly is provided at an upper end of the front lower door sash. When assembling the glass pane having the above-mentioned shape, therefore, it is possible to further improve assembly of the glass pane and to greatly cut down the number of assembly steps.

According to still another aspect, the present invention resides in a glass guide construction for a vehicular door in which an upper door sash for guiding a glass pane is provided in a window opening formed in a door panel body of the vehicular door, and a lower door sash for guiding the glass pane into the door panel body is provided in the door panel body at a position under the upper door sash, wherein the glass pane is formed such that an outer peripheral shape is defined by lines connecting at least four front lower, rear lower, front upper and rear upper corners of the glass pane, and that, of diagonal lines connecting the corners, one diagonal line passing through the rear lower corner is longer than the other; and wherein a rear lower door sash is disposed under a rear lower portion of the upper door sash in a vertically spaced relation to a lower end of the rear lower portion, and a guide portion bent to extend obliquely rearwardly is provided at an upper end of the rear lower door sash. When assembling the glass pane having the above-mentioned shape, therefore, it is possible to further improve assembly of the glass pane and to greatly cut down the number of assembly steps.

According to still another aspect, the present invention resides in a glass guide structure for a vehicular door in which an upper door sash for guiding a glass pane is provided in a window opening formed in a door panel body of the vehicular door, and a lower door sash for guiding the glass pane into the door panel body is provided in the door panel body at a position under the upper door sash, wherein a front lower door sash is disposed under a front lower portion of the upper door sash in a vertically spaced relation to a lower end of the front lower portion, and a guide portion bent to extend obliquely forwardly is provided at an upper end of the front lower door sash; and wherein a rear lower door sash is disposed under a rear lower portion of the upper door sash in a vertically spaced relation to a lower end of the rear lower portion, and a guide portion bent to extend obliquely rearwardly is provided at an upper end of the rear lower door sash. Therefore, either the guide portion provided on the front lower door sash or the guide portion provided on the rear lower door sash can be used to assemble the glass pane. Also, similar advantages as those obtained when arranging the front lower door sash or the rear lower door sash according to one of the above aspects can be obtained. More specifically, the spacing between the lower end of the front lower portion of the upper door sash and the upper end of the front lower door sash or the spacing between the lower end of the rear lower portion of the upper door sash and the upper end of the rear lower door sash can be utilized as a work space for assembling the glass pane. All of the door sashes can be mounted prior to assembling the glass pane, and the number of assembly steps can be reduced in comparison with conventional procedures of mounting a lower door sash after assembling a glass pane. Further, since the glass pane is assembled in a condition where the front lower door sash and the rear lower door sash have been mounted beforehand, it is possible to avoid a change in assembly arrangement for mounting the front lower door sash and the rear lower door sash, and to reduce a space occupied by equipment necessary for the assembly. There is no risk that the glass pane may be damaged, because the glass pane is assembled after mounting all of the door sashes. Moreover, since the glass pane can be assembled in place by rotating it while keeping a front upper corner or a rear upper corner of the glass pane in abutment with the guide portion, even a worker who is not skilled in the assembly of the glass pane can easily perform the assembly work, and the number of working steps can be reduced. In addition, since the guide portion is able to receive rainwater or other water having entered the door panel, the water can be prevented from leaking into the vehicle compartment and can be surely discharged out of the vehicle.

Although the invention has been described with reference to an exemplary embodiment, it is understood that the words that have been used are words of description and illustration, rather than words of limitation. Changes may be made, within the purview of the appended claims, as presently stated and as amended, without departing from the scope and spirit of the present invention in its aspects. Although the invention has been described herein with reference to particular means, materials and embodiments, the invention is not intended to be limited to the particulars disclosed herein. Instead, the invention extends to all functionally equivalent structures, methods and uses, such as are within the scope of the appended claims.

The present disclosure relates to subject matter contained in priority Japanese Application No. 2001-350010, filed on Nov. 15, 2001, and in Japanese Application No. 2002-084837, filed on Mar. 26, 2002, which are herein expressly incorporated by reference in their entireties.

What is claimed is:

1. A glass guide construction comprising:

an upper door guide, that guides a glass pane, being positioned along a window opening formed in a door panel body of a vehicular door, and a lower door guide, including a front lower door guide, that guides the glass pane into the door panel body, being positioned in the door panel body at a position under said upper door guide;

said front lower door guide being positioned under a front lower portion of said upper door guide and vertically spaced from a lower end of said front lower portion by a predetermined distance so as to form a space for the glass pane;

a bent guide portion that extends forwardly with respect to a front of the door and obliquely with respect to said front lower door guide, said bent guide portion being positioned at an upper end of said front lower door guide.

said bent guide portion engaging the glass pane as the glass pane is inserted into said door guides.

2. The glass guide construction for according to claim 1, wherein a base end of said bent guide portion is bent and extends linearly to an upper end of said bent guide portion.

3. The glass guide construction for according to claim 2, wherein said upper end of said bent guide portion forms an acute angle with a line between the lower end of the front lower portion of the upper door guide and said base end of said bent guide portion.

4. The glass guide construction for according to claim 2, wherein said bent guide portion is configured such that a width of said bent guide portion gradually increases from said base end toward said upper end of said bent guide portion.

5. The glass guide construction for according to claim 4, wherein the width of said bent guide portion at said base end and the width of said bent guide portion at said upper end are each greater than a width of the lower end of the front lower portion of the upper door guide.

6. The glass guide construction for according to claim 2, wherein said base end of said bent guide portion is unitarily formed with the front lower door guide.

7. The glass guide construction for according to claim 2, wherein said base end of said bent guide portion is fastened to the front lower door guide.

8. The glass guide construction for according to claim 2, wherein said bent guide portion is configured such that a cross-section thereof, taken in a direction substantially transverse to a longitudinal direction thereof from said base end toward said upper end, has a trapezoidal shape.

9. A glass guide construction for comprising:

an upper door guide, that guides a glass pane, being positioned along a window opening formed in a door panel body of a vehicular door, and a lower door guide including a front lower door guide, that guides the glass pane into said door panel body being positioned in said door panel body at a position under said upper door guide, said front lower door guide being positioned under a front lower portion of said upper door guide vertically spaced from a lower end of said front lower portion by a predetermined distance so as to form a space for the glass pane, and a bent guide portion that extends forwardly with respect to a front of the door and obliquely with respect to said front lower door guide, said bent guide portion being positioned at an upper end of said front lower door guide and engages the glass pane as the glass pane is inserted into said door guides, wherein the glass pane is formed such that a distance from a lower front corner to an upper rear corner of the glass pane is greater than a distance from a upper front corner to a lower rear corner of the glass pane.

* * * * *

UNITED STATES PATENT AND TRADEMARK OFFICE

CERTIFICATE OF CORRECTION

PATENT NO. : 6,880,292 B2
DATED : April 19, 2005
INVENTOR(S) : G. Okahara

It is certified that error appears in the above-identified patent and that said Letters Patent is hereby corrected as shown below:

Title page,
Item [57], ABSTRACT,
Line 3, "The door" should be -- The guide assembly --.
Line 7, after "lower" insert -- door guide to aid in the installation of the glass pane into --.

Column 9,
Line 9, after "construction" delete "for".
Line 12, after "guide" insert -- , --.

Signed and Sealed this

Twenty-seventh Day of December, 2005

JON W. DUDAS
*Director of the United States Patent and Trademark Office*